United States Patent [19]

Johnson

[11] 4,160,539

[45] Jul. 10, 1979

[54] HAND OPERATED JACK FOR A MULTIPURPOSE JIG APPARATUS OF THE TYPE INCLUDING A LENGTH OF PIPE AND A PLURALITY OF RELEASABLE, PIPE-GRIPPING TAIL STOPS

[76] Inventor: Harold R. Johnson, Ste. 102, 195-21st, West Vancouver, British Columbia, Canada, V7V 4A4

[21] Appl. No.: 872,468

[22] Filed: Jan. 26, 1978

[51] Int. Cl.[2] ..... B66F 1/02

[52] U.S. Cl. ..... 254/106

[58] Field of Search ..... 254/29 R, 30, 31, 106–107

[56] References Cited

U.S. PATENT DOCUMENTS 2,217,403 10/1940 Gunn ..... 254/106

*Primary Examiner*—Robert C. Watson

*Attorney, Agent, or Firm*—Christensen, O'Connor, Johnson & Kindness

[57] ABSTRACT

In a multipurpose jig apparatus of the type including a length of rigid pipe and a plurality of tail stops slidably mounted on the pipe and releasably gripping it so as to resist movement therealong in one direction but permit movement along the pipe in the other direction, a hand-operated jack is removably mounted on the pipe and in association with two tail stops for forcing such stops along the pipe in reaction to a mechanical advantage developed by a lever component of the jack. In one embodiment, the jack has an elongate, hand operated lever that is pivotally connected to a fulcrum support which in turn is integrally formed at one end of an otherwise conventional tail stop. An end of the lever opposite that of the handle is provided with cam and hook elements which couple the lever to another, adjacent tail stop. The handle end of the lever is grasped and stroked back and forth so as to cause the two tail stops and the lever to coact in an alternating push-pull sequence which advances the tail stops and the jack along the pipe in the direction in which the stops are free to move. Any counteracting force in the opposite direction is resisted by the unidirectional gripping action of the tail stops. In another embodiment, the jack lever is detachably mounted on the pipe by a C-shaped collar which fits around the pipe and is shouldered against one end of a first conventional tail stop. The C-shaped collar has an integrally formed fulcrum support on which the lever of the jack is pivotally mounted, and the end of the lever opposite the handle end is provided with camming elements which act to push a second and adjacent tail stop away from the first stop. Both tail stops and the jack are progressively advanced along the pipe by using the mechanical advantage of one stroke of the lever to push the first tail stop along the pipe in reaction to the fulcrum support and the C-shaped collar which are braced and thus held immobile by the first tail stop. Then, during the return stroke of the jack lever, the first tail stop and the C-shaped collar shouldered thereby are manually slipped up against the second tail stop whereafter the sequence is repeated. The mechanical advantage which enables the tail stops to be jacked along the pipe, over any desired length of travel, greatly enhances the usefulness of the jig apparatus when employed in either a clamping or spreading configuration, and furthermore enables new uses of the jig apparatus including hoisting, pulling and jacking up loads.

13 Claims, 8 Drawing Figures

HAND OPERATED JACK FOR A MULTIPURPOSE JIG APPARATUS OF THE TYPE INCLUDING A LENGTH OF PIPE AND A PLURALITY OF RELEASABLE, PIPE-GRIPPING TAIL STOPS

BACKGROUND OF THE INVENTION

The present invention pertains to a hand-operated jack mechanism suitable for use with a multipurpose jig apparatus of the type including a length of rigid pipe and a plurality of releasable, pipe-gripping, tail stops which are slidably mounted on the pipe.

Multipurpose jigs of this general type use any desired length of standard, steel pipe (alternatively a solid elongate bar or rod may be employed) and the tail stops are formed with bores, fitted to the pipe, so that they may be moved to any selected position along the pipe. Workpiece engaging faces provided on the tail stops may be disposed in inwardly confronting relationship for clamping together opposite sides or edges of a work object. Or the tail stop faces may be arranged in an outwardly opposed relation to exert a spreading force between two objects or between spaced points on the same workpiece.

In one version of the jig, each tail stop is provided with a spring biased, manually releasable dog that is pivotally mounted on the body of the tail stop and is oriented relative to the bore such that a serrated portion of the dog is forced into gripping engagement with the pipe in reaction to a force tending to move the tail stop along the pipe in one given direction. As the applied force in that direction increases, the gripping action of the dog thereby resisting increases resisting any displacement of the tail stop along the pipe. If it is necessary to move the tail stop in that same direction, the dog can be manually released from its gripping position and the stop slid freely along the pipe. A force applied to the tail stop in the opposite direction causes the gripping action of the dog to automatically release and thereby enable the tail stop to be moved freely in such direction without the need to manually disengage the dog.

In this manner, each tail stop may be slid along the pipe until its workpiece engaging face is snugly into contact with the workpiece whereupon the workpiece will be restrained in that position, with the tail stop resisting any counteracting force exerted by the workpiece.

Another version of the multipurpose jig uses tail stops in which the gripping mechanism therefor consists of a stack of annular shaped clutch discs that encircle the pipe and are held in a specially formed portion of the tail stop body. The inside diameter of the stack of discs is oversized with respect to the circumference of the pipe and a spring is associated with the discs, forcing them to a skewed orientation with respect to the pipe so that the discs bind on the outer surface of the pipe, and thereby exert a gripping force that holds the tail stop in place. One or more of the annular discs is formed with a radially projecting portion which may be manually grasped and displaced to force the discs out of their skewed orientation in order to release the gripping action and thereby enable the tail stop to be slid freely along the pipe to the desired position.

In still another version of the jig apparatus, one or more of the tail stops is constructed of two parts forming opposing halves of a split sleeve configuration. The two halves of the split sleeve are formed with interengageable portions which enable each sleeve half to be held against the pipe, on diametrically opposite sides thereof, and then interengaged to assemble the tail stop on the pipe, without requiring it to be slid onto the pipe from an end thereof. In many applications one or both ends of the pipe are inaccessible or obstructed and it is impossible or inconvenient to install the tail stop or stops over an end of the pipe, and in such cases the split sleeve configuration of the tail stops is preferred.

Some tail stops are equipped with screw adjustable clamping mechanisms which can be used to apply a screw-leveraged force (much like a C-clamp) against the workpiece. However, as discussed herein, such screw mechanisms have several drawbacks which limit their usefulness.

While multipurpose jigs of the foregoing type, including the several different versions of tail stop design, have proven utility, nevertheless there are several situations in which currently available jigs and their associated tail stops are incapable of or are unsuitable for being used to perform certain desirable functions, which if available, would complement and thereby enhance the usefulness of such jigs.

It is therefore an object of the invention to provide in combination with such a multipurpose jig apparatus, a hand-operated jack that mounts on the pipe and coacts with one or more of the above types of pipe mounted tail stops in a manner that enables such tail stops to be forcefully displaced along the pipe with a mechanical advantage that is developed by a hand actuated lever.

Another object of the present invention is to provide a hand-operated jack for use with a multipurpose jig apparatus of the above characterized type in order to enhance the versatility of the jig apparatus by enabling it to be used as a lifting jack and/or a hoist.

Another object is to provide such a hand-operated jack for use with a multipurpose jig apparatus of the above-mentioned type which is relatively inexpensive to manufacture, which is durable so as to provide a long trouble-free life, and which is easy to use and reliable so that it can be employed with relative safety and effectiveness by professional craftsmen and hobbyists alike.

SUMMARY OF THE INVENTION

A hand-operated jack lever mechanism is integrated with a multipurpose jig apparatus of the general type referred to above, in which the lever mechanism is constructed and mounted on the pipe in a manner that permits one or more of the jig tail stops to be forcefully advanced along the pipe, over any desired length of travel, and with a working force that is developed by the mechanical advantage of the lever. In particular, the jack mechanism includes an elongate lever, having a handle at one end, and being pivotally mounted adjacent the other end on a fulcrum support which in turn is attachable to the pipe. The point of attachment is selected to position the fulcrum support, for the lever, between first and second tail stops of the type characterized above, which releasably grip the pipe so as to permit the stops to be moved in one direction along the pipe, while resisting displacement in the opposite direction. Camming means are provided on the lever, adjacent the second end, such that the handle of the lever can be manually grasped and stroked back and forth to cause the camming means to move in an arcuate path which extends generally lengthwise along the pipe. The first and second tail stops and the interposed fulcrum support are constructed and arranged so that the fulcrum support is braced by the first tail stop, against slippage along the pipe in a first direction, such that when the handle of the lever is stroked one way the camming means are forced into contact with the second and adjacent tail stop, forcibly pushing the second tail stop away from the fulcrum support and away from the first tail stop and thus along the pipe in the direction in which the tail stops are free to move. At the end of this working stroke, the lever handle is moved back the other way in a return stroke which draws the fulcrum support up against the second tail stop. At the same time, the first tail stop, which previously braced the fulcrum support, is manually slid up against the fulcrum support to position the components for another working stroke. During the operation of the jack mechanism, the counteracting force of the load which is exerted on the second tail stop, is resisted either by the gripping action of the second tail stop, or by the camming force which is applied by means of the lever and which is braced by the first tail stop.

In one embodiment of the invention, the fulcrum support means is attached to the pipe by a C-shaped collar that holds the fulcrum support and fits substantially around the circumference of the pipe, and which may be removed and reattached to the pipe, at any selected position therealong. The collar is positioned on the pipe so that the face at one axial end thereof is shouldered by the first tail stop. The C-shaped collar and attached fulcrum support are thereby braced by the gripping action of the first tail stop.

In another embodiment, the fulcrum support is attached to the pipe by fixedly joining the fulcrum support directly to a body of the first tail stop so that the fulcrum support and first tail stop are mounted on the pipe as a preconnected unit. In this case, it is preferable to construct the body of the first tail stop in two parts, forming opposite, interengageable parts of a split sleeve configuration so that the first tail stop, and the fulcrum support affixed thereto, can be attached to the pipe by disengaging the split sleeve parts, placing them on diametrically opposed sides of the pipe and then rejoining the sleeve parts. In this manner the jack mechanism of the invention can be mounted at any position along the pipe, as in the case of the above disclosed C-shaped collar embodiment, without requiring that the tail stop and attachment means for the fulcrum support be installed by slipping them over an end of the pipe.

In the embodiment in which the fulcrum support means is fixedly joined to the first tail stop, hook means are provided on the end of the lever, adjacent the camming means, for coacting with hook receiving means provided on the body of the second and adjacent tail stop, such that the lever handle may be stroked in one direction to cause the camming means to forcibly push the second stop away from the first, and thus advance the second tail stop along the pipe, as described above, and then stroked in the opposite and return direction to cause the hook means to catch on the now immobilized second tail stop and act to pull the lever, fulcrum support and the attached body of the first tail stop up against the adjacent end of the second stop. The components are now in a position which enables the subsequent working stroke of the lever handle to displace the second tail stop further along the pipe. Repetitive strokes of the lever handle thus increment the tail stops and fulcrum support along the pipe in the direction opposite to that in which the tail stops resist movement.

In each of the above versions, the elongate lever is preferably forked adjacent the non-handle end and is pivotally mounted on the fulcrum support at a location intermediate the first and second ends of the lever so that when the handle of the lever is pivoted to a substantially right angle position with respect to the pipe, the forked end of the lever straddles the pipe. The camming means, and if applicable, the hook means, are formed in pairs and are mounted on the opposed legs of the forked end of the lever so that the forces that are applied between the lever and the second tail stop, act equally on both of the sides of the pipe.

In the foregoing manner, the versatility and thus utility of a multipurpose jig apparatus of the characterized type is greatly enhanced by providing a manually operated jack mechanism which can be integrated with a number of styles of tail stops used in this type of jig. One primary advantage of the added jack mechanism is to enable the tail stops to be forced along the pipe, to any desired position, over any needed or desired length of travel, to exert a clamping or spreading force on a workpiece. Unlike other jig apparatus of this general type, the force or forces with which the tail stops can be pressed against the workpiece are significantly increased by reason of the mechanical advantage developed by the lever. Moreover, even those prior devices which afford some mechanical advantage in displacing the workpiece tail stops into position, such as devices equipped with screw positionable workpiece tail stops, are far less versatile because the length of travel of the mechanism is limited by the length of the screw, which is much shorter than the overall length of the pipes normally employed in the jig apparatus.

Also, because of this unlimited length of travel provided by the invention, the jack mechanism may be used as a hoist (or puller), in which, for example, the second tail stop is equipped with an accessory to which hoisting (or pulling) chains or ropes may be attached. In such case, the pipe is oriented vertically (or horizontally if used as a puller) and the tail stops and associated lever are advanced along the pipe while the hoisting (or pulling) chain is attached to a load that is to be raised (or pulled). In a similar manner, the mechanism is also useful as a jack. By placing the workpiece engaging face of the second tail stop beneath an object that is to be lifted, the jack mechanism is operated to advance both tail stops upwardly on the pipe, with the weight of the object being supported by the upper end of the second tail stop.

As a further advantage, the jack mechanism of the invention is constructed such that the leverage forces developed thereby are applied in a balanced fashion to opposed sides of the pipe and tail stops, and at locations close to the center line of the pipe so that when the jig apparatus is heavily stressed, there is less of a tendency for the pipe to bow, which is a common problem encountered using other leverage mechanisms in conjunction with jig apparatus of this general class. For example, the above-mentioned screw-operated mechanisms that are sometimes available as accessories to the jig apparatus employ a screw driven sliding head to develop a leveraged clamping force on the workpiece. Because of inherent design limitations, center line of the screw in such mechanisms is offset from the center line of the pipe by such an extent that when the screw is tightened there is a marked tendency of the pipe to bow, especially when the clampled workpiece is relatively large. The bending of the pipe causes misalignment of the workpiece engaging faces of the tail stops and consequent difficulty in obtaining a positive, stable clamping or spreading force on the workpiece. In some cases the resulting misalignment causes the tail stops to slip off the workpiece. Also, permanent bow deformation of the jig pipes occurs rendering them unsuitable for precision work. The jack mechanism of the present These and further features, objects and advantages of the invention will become apparent to those skilled in the art from the following detailed description and appended drawings.

DETAILED DESCRIPTION

Figure 2:
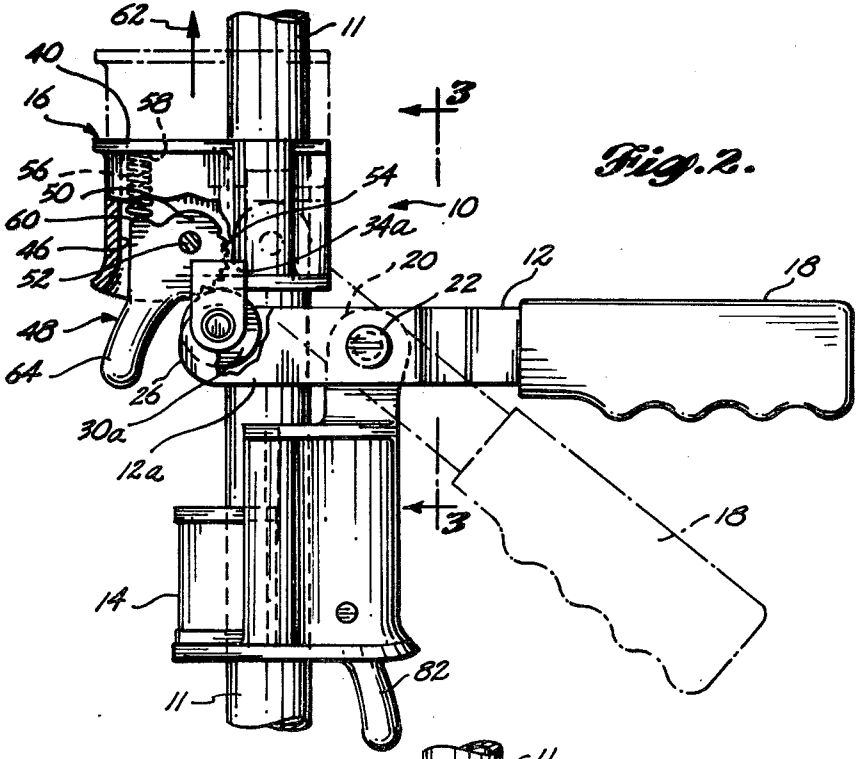
FIG. 2 is a side elevation view of the hand-operated jack of FIG. 1.
Figure 3:
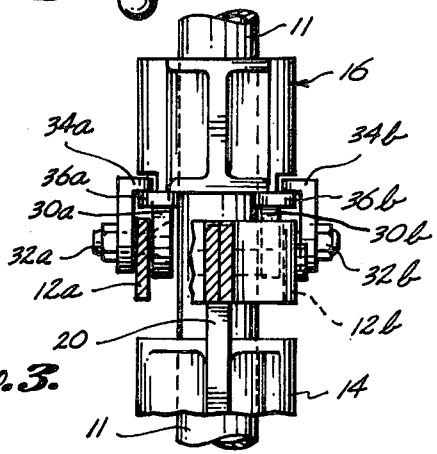
FIG. 3 is a fragmentary view of the hand-operated jack, shown as a rear elevation, and partly in section taken along line 3—3 of FIG. 2.
Figure 1:
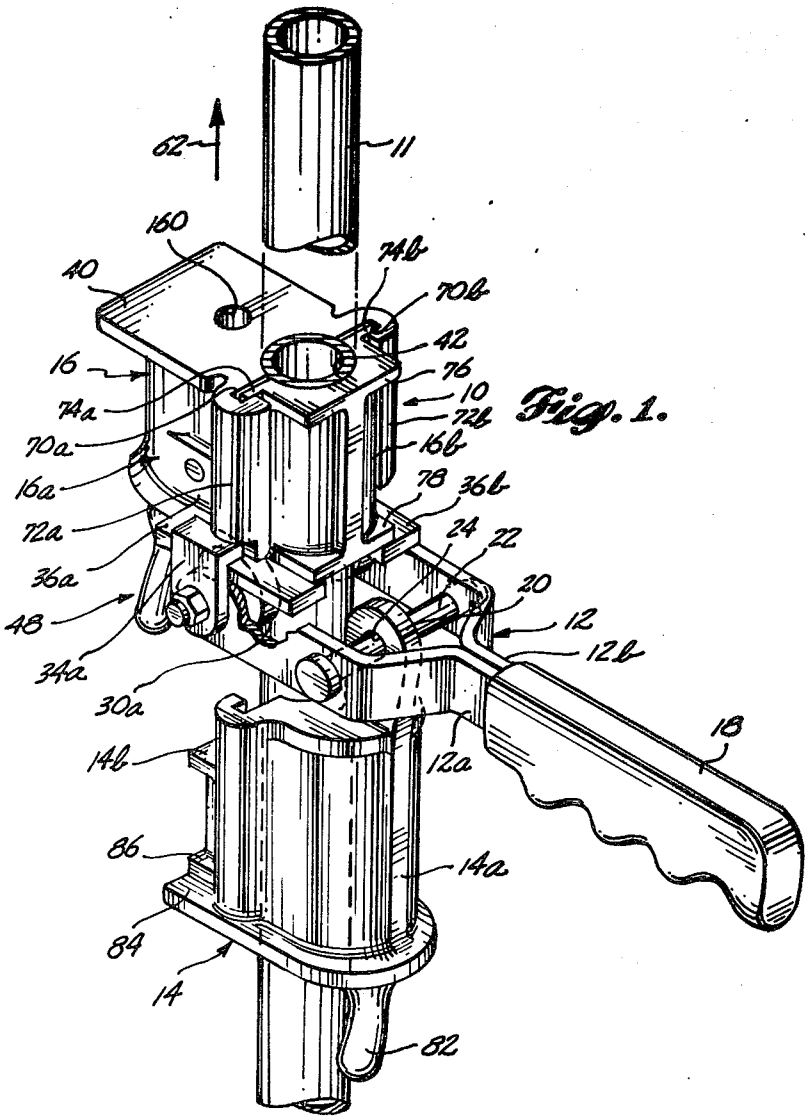
FIG. 1 is an isometric view of the hand-operated jack of the invention, integrated with a multipurpose jig apparatus of the above characterized type.

With reference to FIGS. 1, 2 and 3, the hand-operated jack 10 of the invention is integrated with a multipurpose jig apparatus of the type including a length of rigid pipe 11 and a plurality of releasable, pipe gripping tail stops. Two such tail stops 14 and 16, have been modified, in accordance with this embodiment of the invention, and combined with jack lever 12, to form the hand-operated jack 10 that fits on pipe 11.

Jack lever 12 is constructed of two pieces of juxtaposed steel bar stock 12*a* and 12*b* which are welded together adjacent one of their ends to fabricate a straight, double bar section suitable for receiving a plastic hand grip, or the like, to form a handle 18 adjacent one end of lever 12. At the opposite end of the lever, steel bars 12*a* and 12*b* are spread apart, in a forked configuration, which straddles pipe 11 such that the end portions of the spread bars 12*a* and 12*b* are disposed on opposite sides of the pipe. At a location adjacent the forked end of lever 12, it is pivotally mounted on a fulcrum support 20 by a pivot pin 22 which passes through a hole 24 formed in support 20 and which has its opposite ends secured in mounting holes provided in spaced bars 12*a* and 12*b* at a position between handle 18 and the ends 26 (FIG. 2) of bars 12*a* and 12*b*. Fulcrum support 20, in this embodiment, is attachable to pipe 11 by forming support 20 as an integral lug projecting outwardly from an end of a first of the tail stops, namely stop 14. By doing so, fulcrum support 20 is oriented on pipe 11 such that the pivot axis for lever 12 provided by the pivot pin 22 extends transversely with respect to pipe 11 and is spaced slightly outwardly from the pipe as best shown in FIG. 2.

Mounted adjacent the ends 26 of lever bars 12*a* and 12*b* are a pair of roller cams 30*a* and 30*b* (FIG. 3). Cams 30*a* and 30*b* are rotatably fastened to the inwardly opposed surfaces of bars 12*a* and 12*b* by nut and bolt assemblies 32*a* and 32*b* and are sized and arranged with respect to bars 12*a* and 12*b* such that a peripheral portion of the outer circumference of each roller cam protrudes beyond the edges of bars 12*a* and 12*b* which are adjacent the second tail stop 16. The protruding peripheral portions of cams 30*a* and 30*b* are disposed so that they can be moved into contact with and bear against flanges formed on the adjacent end of the second tail stop 16 for pushing tail stop 16 away from tail stop 14, in the direction of arrow 62 shown in FIGS. 1 and 2.

In addition to roller cams 30*a* and 30*b*, the forked ends of bars 12*a* and 12*b* of lever 12 mount a pair of inverted, L-shaped hook members 34*a* and 34*b* (FIG. 3) which cooperate with hook receiving flanges 36*a* and 36*b* provided on the second tail stop 16 for enabling lever 12 to pull tail stop 14 toward tail stop 16 during a return stroke of the lever (counterclockwise rotation as viewed in FIG. 2). As shown in FIG. 3, hook members 34*a* and 34*b* are mounted on the outwardly opposed surfaces of bars 12*a* and 12*b* by the same bolt and nut assemblies 32*a* and 32*b* which attach cams 30*a* and 30*b* to the inwardly opposed surfaces of the bars. Self-locking nuts are used in assemblies 32*a* and 32*b* such that both roller cams 30*a* and 30*b* and members 34*a* and 34*b* are free to rotate relative to bars 12*a* and 12*b*. The shape and size of members 34*a* and 34*b* are such that the longer legs of the members are connected by bolt assemblies 32*a* and 32*b* to bars 12*a* and 12*b* and from such points of connection members 34*a* and 34*b* project toward the second tail stop 16 and beyond the adjacent edges of bars 12*a* and 12*b*. The shorter leg portions of members 34*a* and 34*b* are inwardly opposed so as to present catch surfaces which contact and ride on cooperating flanges 36*a* and 36*b* which are affixed to and transversely oriented on tail stop 16. When mounted on pipe 11 and coupled to tail stop 16, cams 30*a* and 30*b* and hook members 34*a* and 34*b* contact opposing surfaces of flanges 36*a* and 36*b* so as to hold each flange captive between the opposing surfaces of one cam and the shorter leg of one hook member. The rotative mounting of cams 30*a* and 30*b*, and members 34*a* and 34*b*, permit these elements to roll and slide, respectively, along the transversely oriented flanges 36*a* and 36*b* of tail stop 16, to accommodate the transverse component of motion of these elements as they move in an arcuate path when lever 12 is pivoted back and forth on pin 22 and fulcrum support 20.

Both of the tail stops 14 and 16 are of a split sleeve construction and as shown by the body of stop 16, interengaging sleeve parts 16*a* and 16*b* are formed and associated so that when these parts are disengaged they may be attached to, or removed from pipe 11 at any desired, intermediate point therealong. Flanges 36*a* and 36*b* are in this case both affixed to sleeve part 16*a* at one axial end of tail stop 16 (alternatively they can both be affixed to sleeve part 16*b*, or one to part 16*a* and the other to part 16*b*). Adjacent ends of flanges 16*a* and 16*b* are connected to sleeve part 16*a* and are supported thereby such that the opposite ends project transversely, and in spaced parallelism away from part 16*a*, so as to provide a gap 44 therebetween which has sufficient width to pass freely over the outer diameter of pipe 11. Flanges 36*a* and 36*b* are each of a generally rectangular cross section to present a uniform thickness which is sized to fit snugly between the opposing, flange engaging surfaces of member 34*a* and cam 30*a*, and member 36*b* and cam 30*b*. The length of flanges 36*a* and 36*b* is selected to accommodate the transverse component of travel of members 34*a*, 34*b* and cams 30*a* and 30*b*, as lever 12 is pivotally reciprocated through a full working and return stroke.

The body of sleeve part 16*a* defines one symmetrical half of a bore 42 sized to slidably fit the tail stop on pipe 11, and includes an enlarged, radially protruding portion, projecting outwardly from pipe 11 in the opposite direction to the projection of flanges 36*a* and 36*b*, and handle 18 of lever 12. At the axial end of part 16*a* opposite that of flanges 36*a* and 36*b*, a flat surface, lying orthogonally to the axis of bore 42, provides the workpiece engaging face 40. In line with face 40, and within the interior of the radially protruding body of part 16*a*, a cavity 46 is formed which opens at the axial end of part 16*a* that mounts flanges 36*a* and 36*b*. Mounted within cavity 46 is a self-tightening, manually releasable dog 48 having a cam portion 50 which is pivotally, and eccentrically mounted on a pin 52, which in turn is held at its opposite ends within holes provided in the body portions of part 16*a* that form the side walls of cavity 46. The axis of pin 52 extends transversely to pipe 11 and is spaced outwardly from the pipe so that as cam portion 50 is rotated counterclockwise (as viewed in FIG. 2), a circumferential, serrated edge 54 of cam portion 50 increasingly grips the outer surface of pipe 11. A helical, compression spring 56 is also mounted within cavity 46 so as to bear between an interior wall portion 58 of cavity 46 and a knob-like protuberance 60 formed on dog 48 on the opposite side of pin 52 from serrated edge 54. Spring 56 urges dog 48 in a counterclockwise direction of rotation (again as viewed in FIG. 2) so as to continuously force dog 48 to grip pipe 11. Further and more severe gripping action occurs whenever tail stop 16 is forced, relative to pipe 11, in a direction opposite to that indicated by arrow 62. This self-tightening, gripping action of dog 48 may be manually released so that tail stop 16 can be slid along pipe 11 in the direction opposite that of arrow 62, by manually grasping a release lever 64 which protrudes outwardly through the open axial end of cavity 46. Also, the gripping action of dog 48 is automatically released whenever a force acts on tail stop 16, relative to pipe 11, to slide stop 16 in the direction of arrow 62. It is observed that the radially protruding body of part 16*a*, which defines workpiece engaging face 40, and includes cavity 46 which holds dog 48, is on the opposite side of bore 42 and pipe 11 from the handle 18 of lever 12. Thus, the workpiece which is held by face 40 of tail stop 16 (and another similarly formed tail stop mounted on pipe 11) is on the diametrically opposite side of pipe 11 from lever handle 18, to avoid interference therebetween. Also, this arrangement of lever 12 places the fulcrum support 20 on the same side of the pipe as dog 82 of tail stop 14, thereby insuring that the load applied to support 20 via lever 12 is effective to increase the gripping action of dog 82.

Part 16*a* of tail stop 16 is also formed with inwardly opposed, axially elongate grooves 70*a* and 70*b* provided in diametrically opposed, elongate ears 72*a* and 72*b* located on opposite sides of bore 42. Complementary, outwardly opposed, elongate flanges 74*a* and 74*b* are integrally formed on sleeve part 16*b* of tail stop 16, such that part 16*b* which defines the other symmetrical half of bore 42 can be fitted onto pipe 11 at an axially offset position with respect to part 16*a* and then slid along pipe 11 to cause flanges 74*a* and 74*b* to slide into interlocking engagement with grooves 70*a* and 70*b* of part 16*a*. Once interlocked (as shown in FIGS. 1, 2 and 3) the sleeve parts of tail stop 16 are held securely together, preventing any separation therebetween in reaction to forces transverse to the pipe. Transversely projecting foot portions 76 and 78 are provided at each axial end of part 16*b* such that one of these foot portions, namely portion 78 in the drawings, is shouldered against the upper surfaces of flanges 36*a* and 36*b* to hold part 16*b* in interlocking position with part 16*a*. Normally tail stop 16 will be forced along pipe 11 in the direction of arrow 62 as shown in FIG. 1 and thus the frictional forces on parts 16*a* and 16*b* tend to hold part 16*b* shouldered against flanges 36*a* and 36*b*.

Tail stop 14 is similar to tail stop 16 and thus is of a split sleeve construction and includes a first sleeve part 14*a* and a second sleeve part 14*b*. Sleeve part 14*a* serves as the point of attachment of fulcrum support 20, and the workpiece engaging face 40 that is provided on part 16*a* of stop 16 is replaced, on part 14*a* of stop 14, by an axially projecting lug, integral with part 14*a*, and serving as support 20. The opposite axial end of part 14*a* mounts pipe-gripping dog 82 which is identical to dog 48 of stop 16. Additionally, part 14*a* is not, in the illustrated embodiment, provided with flanges similar to flanges 36*a* and 36*b* on tail stop 16, although such flanges may be formed on part 14*a* of tail stop 14 if desired to reduce the number of manufacturing dies or casting molds. In either case, part 14*a* is provided with shoulders 84, corresponding to the portions of flanges 36*a* and 36*b* adjacent gap 44 of part 16*a*, for shouldering a foot portion 86 at one end of sleeve part 14*b*, in the same manner that flanges 36*a* and 36*b* shoulder foot portion 78 of sleeve part 16*b*. The axial length of part 14*b* is shortened relative to part 14*a* so that part 14*b* may be slid upwardly as viewed in the drawings and disengaged from part 14*a* when lever 12 is pivoted to the position shown in FIG. 2. In this manner tail stop 14 and lever 12 may be removed from the pipe 11 while leaving tail stop 16 in a load supporting position on the pipe. When assembled on pipe 11, part 14*a* which mounts the fulcrum support is positioned on the opposite side of the pipe from the corresponding part 16*a* so that lever handle 18 will be disposed away from the workpiece held by face 40 of stop 16, and thus accessible for manual actuation.

OPERATION

When used as a jack for forcing tail stop 16, and more particularly face 40 thereof, into clamping engagement against a work object, jack 10 is initially mounted on pipe 11 by using the split sleeve construction of tail stops 14 and 16 to attach both tail stops and lever 12 to the pipe at the desired location. As mentioned above, the split sleeve feature of tail stops 14 and 16 enables the placement of jack 10 in an operative position on pipe 11, without requiring that either tail stop be slipped over a free end of the pipe. In many applications, the ends of the pipe are not accessible for endwise mounting of the tail stops, such as when the pipe is used as a stanchion between a floor and a ceiling joist, and in such situations, the split sleeve construction of the tail stops is a necessary feature of the jack mechanism. Tail stop 14 and the attached lever 12 can be mounted on pipe 11 separately from tail stop 16 and then coupled to tail stop 16 by moving sleeve part 16*a* into position from the opposite side of pipe 11 from lever 12 qnd simultaneously slipping the ends of flanges 36*a* and 36*b* that define gap 44 into position between members 34*a*, 34*b* and cams 30*a*, 30*b*. Thereafter, sleeve part 16*b* is fitted onto pipe 11 and slid into interlocking engagement with part 16*a* in the above-mentioned manner to complete the assembly of jack 10.

Tail stop 16 is placed on pipe 11 so that face 40 thereon is in spaced, confronting relationship with another tail stop, or other workpiece restraining device. Now jack 10 is operated to advance both tail stops 14 and 16 in the direction of arrow 62 (as shown in FIGS. 1 and 2) along pipe 11 until the desired clamping force has been effected. The movement of jack 10 along pipe 11 is best understood by analyzing the action of the jack as handle 18 of lever 12 is first displaced through a working stroke (clockwise as viewed in FIG. 2) and thereafter through a return stroke (counterclockwise as viewed in FIG. 2). During the working stroke, handle 18 is forced downwardly as viewed in the drawings, or in other words in the direction of tail stop 14. In reaction thereto, cams 30*a* and 30*b* are displaced, with the mechanical advantage of lever 12, in an arcuate path, in which component of movement occurs generally along pipe 11. The result is that cams 30*a* and 30*b* contact and push on flanges 36*a* and 36*b*, forcing tail stop 16 in the direction of arrow 62 (FIG. 1) and thus away from tail stop 14 which remains immobilized by virtue of the self-tightening, gripping of dog 82 on pipe 11. During such working stroke, tail stop 14 braces fulcrum support 20 on pipe 11 to enable lever 12 and particularly the cams 30*a* and 30*b* to force tail stop 16 in the desired direction of advancement.

At the end of the working stroke, which occurs when lever 12 has been rotated as far as possible in a clockwise direction (shown by the dotted line position of the components in FIG. 2), tail stop 16 has been pushed as far as possible away from the bracing tail stop 14. Now the return stroke is commenced which entails the pulling of handle 18 upwardly as viewed in the drawings, or in other words toward stop 16, thus causing a counterclockwise rotation of lever 12. This results in a force on tail stop 16 in the opposite direction to that of arrow 62 (FIG. 2) and thus activates the self-tightening, gripping action of dog 48, thereby immobilizing stop 16 on pipe 11. Any further effort to pull up on handle 18 forces pin 22 on lever 12 to move upwardly in reaction to the hook members 34*a* and 34*b* which are held immobilized on pipe 11 by stop 16. Fulcrum support 20 is thus pulled upwardly by pin 22, causing dog 82 on stop 14 to automatically release (since the direction of force on stop 14 is now opposite that which causes the automatic gripping action of dog 82). Tail stop 14 is thus pulled upwardly as handle 18 is displaced through a full return stroke, drawing the fulcrum support end of stop 14 snugly up against the forked end of lever 12 and into a position for effecting a successive working stroke. In this manner, lever 12 is reciprocated back and forth, through successive working and return strokes thereby causing tail stops 16 and 14 to be alternately advanced along the pipe with a force developed by the mechanical advantage associated with lever 12. The amount of mechanical advantage is dependent on the ratio of the spacing between pivot pin 22 and the location of bolt assemblies 32*a* and 32*b* which mount the cams and hook members, to the spacing between pin 22 and the effective point of the hand applied force on handle 18.

When it becomes necessary to back jack 10 away from a clamped position, handle 18 is manually forced downwardly toward tail stop 14 to relieve the pressure on dog 48 of tail stop 16, and thereupon dog 48 is manually released by pulling lever 64 outwardly away from pipe 11. The serrated edge 54 of cam 50 is thereby eccentrically rotated away from pipe 11, and the load is borne solely by lever 12 and the manually applied force on handle 18. Lever 12 is now slowly allowed to rotate counterclockwise (as viewed in FIG. 2) until tail stop 16 and the forked end of lever 12 come to rest against the fulcrum end of tail stop 14. Lever 64 is thereupon released and the corresponding lever of dog 82 is pulled outwardly, manually releasing dog 82 from its gripping action and allowing tail stop 14 to slide down along pipe 11 (opposite direction to arrow 62) while tail stop 16 bears the force of the load by means of the gripping action of dog 48. As tail stop 14 is slid away from tail stop 16, lever 12 rotates, clockwise to a position shown by the dotted lines in FIG. 2. Dog 82 is now allowed to grip pipe 11, thereby returning the tail stops and lever to their beginning positions. The sequence is repeated as many times as necessary until jack 10 has been backed off by the desired amount.

In the foregoing operation, the thumb of the hand that is used to operate handle 18 of lever 12 can be positioned to release dog 82 as needed, thereby freeing the opposite hand for selective manipulation of dog 48 of tail stop 16.

While the foregoing operating sequence has been described as a clamping operation, it will be appreciated that jack 10 can be used to equal advantage in a spreading operation. In such case, the face 40 of tail stop 16 is simply arranged in outwardly opposed relation (rather than in confronting relation as described above) with respect to the workpiece engaging face of another tail stop or other workpiece restraining device.

It will be observed that the length of travel of jack 10 along pipe 11 is unlimited by any inherent design feature of the jack. This is in contrast to those currently available accessories which provide some form of mechanical advantage. Because the length of travel is unlimited, jack 10 is useful in several other applications, in addition to the usual clamping and spreading operations as discussed above. For example, jack 10 can be used as a hoist on a vertically oriented pipe. In such case, an accessory may be provided as described more fully herein in connection with FIG. 7, for attaching a hoisting chain or rope to tail stop 16, and then jack 10 is operated to advance the tail stops upwardly, in the direction of arrow 62, on the vertically oriented pipe. During hoisting, the operation of jack 10 is the same as that described above for advancing tail stop 16 into clamping engagement with a workpiece. The hoisted load may subsequently be lowered by using the back off, operating sequence described above to lower tail stops 16 and 14. At all times, the weight of the load is supported either by one of the tail stops, or by the mechanical advantage associated with lever 12.

By orienting the pipe horizontally, and using chains or ropes in a manner similar to the above hoisting operation, the apparatus serves to function as a puller.

Also, jack 10 can be used to jack up a load, as in jacking up the frame of an automobile, by placing the object to be lifted on the upwardly disposed face 40 of tail stop 16 whle pipe 11 is again supported in a vertical orientation. The load may be jacked up and thereafter lowered in the same manner as described above for the hoisting and lowering, respectively, of a load.

Of course, there are many other ways of using jack 10, as will be recognized by those familiar with multipurpose jigs of this type. For example, tools may be attached to or supported by tail stop 16 and then forcefully advanced along pipe 11 into cutting, drilling, or other operative contact with a work object. For example, an electric drill may be supportively mounted on tail stop 16 with the drill bit oriented parallel to the axis of pipe 11. With pipe 11 held fixed with respect to a work object, jack 10 and the supported drill can be advanced along the pipe into drilling contact with the work object. The mechanical advantage of lever 12 can be used in this fashion to position the drill and drill bit with respect to the workpiece and to apply carefully controlled pressure of the drill bit against the work object.

ALTERNATE EMBODIMENTS

Figures 4, 5, 6, 7, 8:
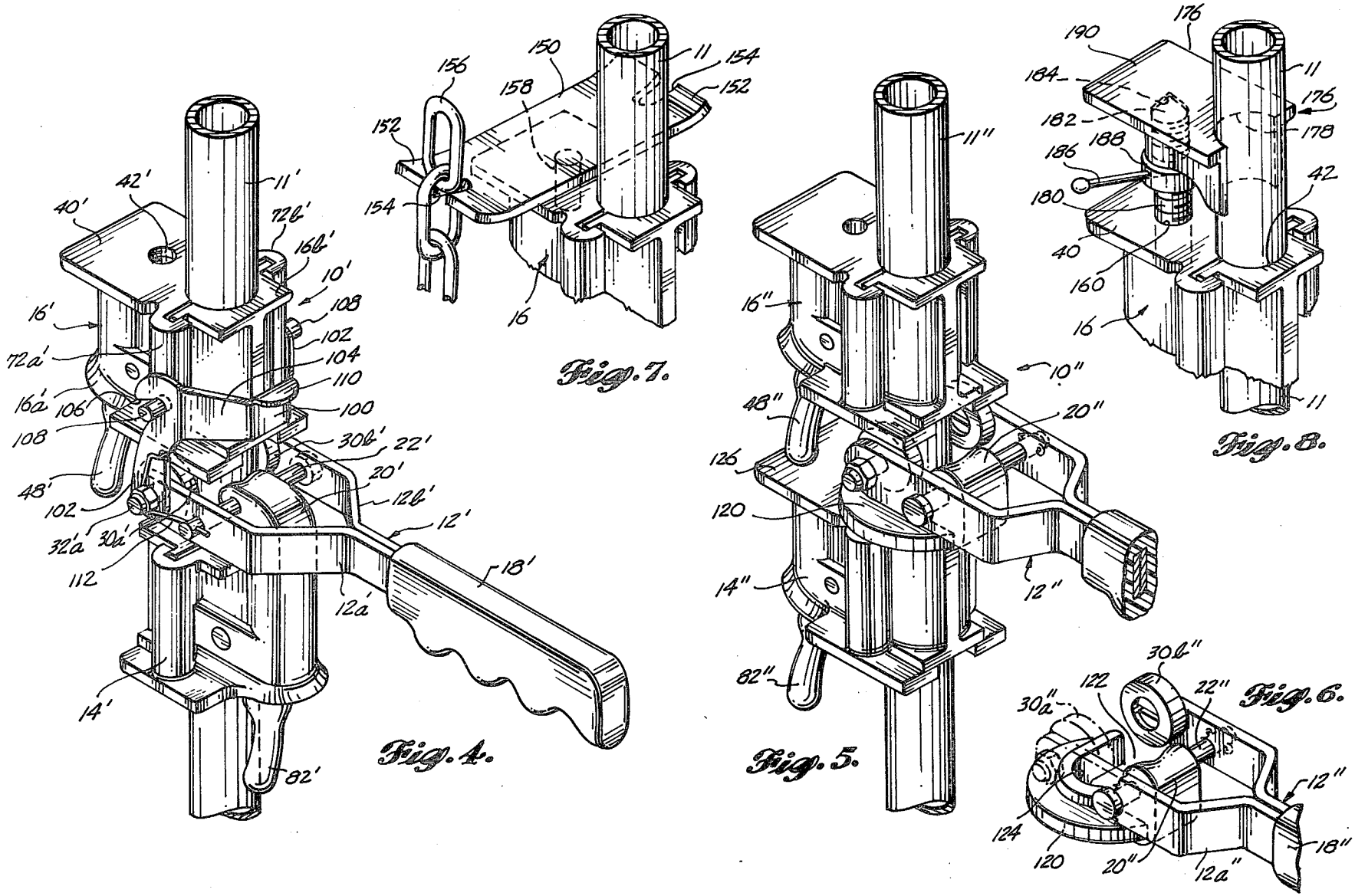
FIG. 4 is an isometric view, similar to FIG. 1, of another embodiment of the hand-operated jack of the invention.
FIG. 5 is still a further isometric view, similar to FIGS. 1 and 4, but with a fragment of the lever handle removed, showing still another embodiment of the hand-operated jack of the invention.
FIG. 6 is a fragmentary, isometric view of the lever and fulcrum support therefor which together comprise a detachable jack lever component of the jack shown in FIG. 5.
FIG. 7 is a fragmentary, isometric view of a tail stop element of the hand-operated jacks of FIGS. 1, 4 and 5, equipped with an accessory for adapting the jack for use as a chain hoist or puller.
FIG. 8 is a fragmentary, isometric view of a tail stop, similar to FIG. 7, showing the adaption of the tail stop with an accessory for providing a screw-operated, fine clamping adjustment once the hand-operated jack has been used to roughly position the clamp with respect to the workpiece.

With reference to FIG. 4, an alternative embodiment of the invention is illustrated by jack 10' in which like reference numerals are used, with a single prime mark, to denote corresponding components and parts described above in connection with the embodiment of FIGS. 1–3. Thus jack 10' comprises a first tail stop 14' including a fulcrum support 20' that mounts hand operated lever 12' for displacing a second tail stop 16' along pipe 11'.

The above-described L-shaped hook members **34*a* and 34*b* (FIGS. 1–3) have been replaced in the embodiment shown in FIG. 4 by a unitary, bail 100 having a pair of spaced apart leg portions 102, the ends of which are pivotally joined to forked bars 12*a'* and 12*b'* by the same set of nut and bolt assemblies (see assembly 32*a'* in FIG. 4) that mount roller cams 30*a'* and 30*b'* to lever 12'. From their pivotally connected ends, legs 102 project upwardly from lever 12' and thus away from tail stop 14', and extend along diametrically opposed sides of tail stop 16' where they are joined together by a band portion 104 of bail 100, which wraps circumferentially around sleeve part 16*b'* of stop 16'. At generally right angle junctures between legs 102 and band portion 104, bail 100 is formed with hook portions 106 which cooperate with diametrically opposed, outwardly projecting pins 108 affixed to ears 72*a'* and 72*b'* of part 16*a'*. When portions 106 are hooked on pins 108, the forked end of lever 12' is coupled to tail stop 16' so as to apply the same pulling force described above in connection with hook members 34*a* and 34*b* of the embodiment in FIGS. 1–3 and so as to afford the necessary freedom of motion of the forked end of lever 12'**.

The openings associated with hook portions 106 are shaped so that bail 100 may be pivotally retracted to disengage portions 106 from pins 108 by grasping a centrally located tab 110 on band portion 104 and rotating bail 100 outwardly and downwardly toward fulcrum support 20'. A steel wire torsion spring 112 is supportively mounted on bolt assembly **32*a'* and has its opposed ends affixed to pin 22 and leg 102 so as to bias bail 100 into hooked engagement with pins 108 of tail stop 116**.

The operation of jack 10' is essentially the same as described above for the embodiment in FIGS. 1–3. The rotatively mounted bail 100 permits tail stop 14' and lever 12' mounted thereon to be attached to pipe 11', and then slid into proximity to the separately attached tail stop 16', whereupon bail 100 is manipulated so as to cause hook portions 106 to hook onto pins 108 to thereby couple the two tail stops for both pulling (by the hook portions 106 of bail 100) and pushing (by the roller cams **30*a'* and 30*b'*). After jacking tail stop 16' to the desired position, tab 110 may be used to disengage hook portions 106 of bail 100 from ends 108 and thereby permit the removal of tail stop 14' and lever 12'** for use elsewhere.

A still further alternative embodiment of the invention is illustrated in FIGS. 5 and 6, in which FIG. 5 depicts a jack 10'' in which the elements and components thereof corresponding to those in the above-described embodiments are identified by like reference numerals having a double prime notation. Jack 10'', unlike the previous embodiments, comprises a self-contained, hand-operated lever 12'' in which the fulcrum support 20'' therefor includes means for attaching the jack lever to the pipe independently of the tail stops. In particular, fulcrum support 20'' is provided by a lug portion integrally formed adjacent one end of a flattened, C-shaped collar 120, as best shown in FIG. 6. The gap 122, formed between the terminal points of the C-shaped configuration of collar 120, is sized so that collar 120 can be fitted from the side onto pipe 11'', with the innermost circumference 124 of collar 120 contoured to conform to the outer circumference of pipe 11''. The lug which provides fulcrum support 20'' projects outwardly (and upwardly as viewed in FIGS. 5 and 6) from the plane that is generally defined by collar 120, so that pivot pin 22'' for lever 12'' is disposed above and generally parallel to such plane and is radially outwardly spaced from the inner circumference 124 of collar 120 that fits against the outer circumference of pipe 11''. The spacing between pin 22'' and the plane of collar 120 is sufficient to permit lever 12'' to be pivoted to a position that is generally parallel to the plane of collar 120, in which position the lower edge of lever bar **12*a''* abuts the upper surface of collar 120. From this position, lever 12'' may be pivoted (in a clockwise direction as viewed in the drawings) to force roller cams 30*a''* and 30*b''*** in generally upwardly oriented arc.

To assemble jack 10'', the self-contained lever 12'', fulcrum support 20'' and supporting collar 120 are attached to pipe 11'' at a location axially interposed the first and second tail stops 14'' and 16''. In this embodiment tail stops 14'' and 16'' may be of conventional construction and need not be specially fabricated, or modified for assembly with the hand-operated lever.

In operation, the face of collar 120, opposite that from which fulcrum support 20'' projects, is shouldered against a first of the tail stops 14''. The axial end of tail stop 14'' that shoulders and thus braces collar 120 is selected to be the same end of the tail stop that has a workpiece engaging face 126 such that the force exerted by collar 120 during operation of lever 12'' causes the self-tightening, gripping action of tail stop dog 82'' to lock tail stop 14'' to the pipe.

The second tail stop 16'' is moved into a position in which the end of tail stop 16'' adjacent the releasable pipe gripping dog 48'' is in contact with roller cams **30*a''* and 30*b''*. The tail stops 14'' and 16''** are moved as close as possible to each other causing the forked end of lever 12″ and collar 120 to be sandwiched therebetween, and thus forcing lever 12″ to assume a position, projecting outwardly from pipe 11″ substantially at a right angle. The handle of lever 12″ is now forced downwardly in the direction of tail stop 14″ (rotted clockwise as viewed in the drawings), causing roller cams 30*a*″ and 30*b*″ to be displaced in a generally upwardly oriented arc that pushes tail stop 16″ upwardly and thus away from tail stop 14″. At the end of this working stroke, the handle of lever 12″ is pulled up (rotated counterclockwise), rotating the forked end of the lever back to the position shown in FIG. 5 and concurrently therewith tail stop 14″ is manually slid upwardly on pipe 11″ such that the upper end of tail stop 14″ is pressed snugly against the lower face of collar 120. The fulcrum support 20″ is now braced by tail stop 14″ at an advanced position along pipe 11″, and thus jack 10″ is poised for another working stroke of lever 12″ which will cam tail stop 16″ further along the pipe. The jack 10″ is backed-off (or lowered) by using the same back-off operating sequence described above for jack 10, shown in FIGS. 1–3.

The easily attachable and detachable C-shaped collar 120 enables the lever 12″ to be used to apply the desired force to tail stop 16″ and then quickly removed so as not to obstruct, or interfere with ensuing work activity. Also, lever 12″ and collar 120 may be attached and used at one point along pipe 11″, and then detached and used at another location between a second pair of tail stops so as to eliminate the need for a multiplicity of identical jack assemblies.

ACCESSORIES

As previously described, the hand-operated jack of the present invention may be used for hoisting loads. As illustrated in FIG. 7, a hoisting accessory in the form of a chain holder 150 may be provided for attachment to a tail stop, such as stop 16 (or stops 16′ and 16″). Holder 150 includes a plate-like metal member, of roughly rectangular shape, having upturned edges 152 formed with notches 154 for receiving and securing a hoisting chain 156 on each side of the plate. A downwardly projecting mounting stud 158 is affixed to the lower, centermost point of holder 150 and is sized so as to be insertable into a hole 160 (see FIG. 1) provided in the workpiece engaging face 40 of tail stop 16.

In use, an upper end of a length of pipe 11 is hung from an elevated support, e.g., a ceiling joist, such as by employing an inverted tail stop, chain holder, and support chains. The jack mechanism (such as mechanism 10 shown in FIGS. 1–3) is then mounted adjacent the lower end of the downwardly depending pipe and the upper tail stop 16 thereof as shown in FIG. 7 is provided with a holder 150 for receiving hoisting chains. One or more chains 156 are arranged on holder 150 so as to hang downwardly therefrom, preferably on both sides of holder 150 and thus on both sides of tail stop 16 for balancing the forces on the tail stop and jack. The lower ends of the chains 156 are attached to a load that is to be hoisted, and jack 10 (FIG. 1) is operated as described above to advance tail stop 16 upwardly on the vertically disposed pipe 11.

Another accessory is illustrated in FIG. 8 as a screw-operated clamping attachment 175 for providing jack 10 with a fine adjustment feature. Attachment 175 includes a slider 176 fitted on pipe 11 immediately above a tail stop, such as tail stop 16 of jack 10 described above in connection with FIG. 1. Slider 176 is formed with a half bore 178 sized to fit against pipe 11 so that slider 176 can be mounted on and removed from the side of the pipe like its associated tail stop 16, and when so mounted, slider 176 may be freely and smoothly slid up and down pipe 11. With slider 176 moved to a position proximate the workpiece engaging face 40 of tail stop 16, one end of a screw member 180 is screwed into internal threads provided in hole 160 that extends inwardly from face 40 and an upper, enlarged and non-threaded end 182 of member 180 is fitted into a conforming recess 184 provided in slider 176 at a location that confronts face 40 of tail stop 16. End 182 must be free to rotate relative to slider 176, but end 182 may be restrained against withdrawal from recess 184. The axis of screw member 180 lies parallel to and is spaced from bores 42 and 178 so that as member 180 is rotated, end 182 thereof travels along a line parallel to the axis of pipe 11.

For rotating screw member 180 with leverage, a transversely disposed rod 186 is slidably mounted in a through hole drilled diametrically through a collar 188 and the body of screw member 180.

Although as mentioned above, the use of screw actuated clamping devices for this type of jig apparatus is generally undesirable because the screw developed force is offset from the axis of the pipe, this disadvantage is minimized in attachment 175 by arranging screw member 180 as close as possible to pipe 11. Because of the closeness of member 180 and pipe 11, it is necessary to slide the operating rod 186 back and forth each time member 180 is turned through a full revolution, in order to clear the end of rod 186 as it passes between collar 188 and the immediately adjacent pipe 11. Also, it is noted that the length of travel of slider 175 is limited by the depth of hole 160 in tail stop 16. In the illustrated embodiment, the depth of hole 160 is approximately one-half to three-quarters of an inch, limiting the travel of slider 176 to that distance. Nevertheless, attachment 175 can be used to advantage in some applications for finely adjusting the clamping force that is exerted by a workpiece engaging face 190 on slider 176, after jack 10 (FIG. 1) has driven tail stop 16 and the associated attachment 175 up against the workpiece with roughly the desired amount of clamping pressure.

While particular embodiments of the invention have been disclosed herein, it will be readily apparent to persons skilled in the art that numerous changes and modifications can be made to such disclosed embodiments without departing from the spirit of the invention. For example, while the hand-operated jack of the invention is most preferably used in conjunction with split sleeve tail stops, as disclosed above, it is also contemplated that one or more of the pairs of tail stops that cooperate with the hand lever may be of a solid body construction. In such case, other types of tail stop to pipe gripping or restraining devices may be used in place of the releasable dog type of restraint as disclosed above. For example, tail stops using stacked annular clutch discs for preventing the movement of the tail stop in one direction along the pipe can be used in combination with the jack lever of the present invention. However, the disadvantage of tail stops featuring the clutch disc restraint mechanism is that the clutch discs completely encircle the circumference of the pipe and thus, are not adaptable to a tail stop having a split sleeve construction, which has distinct advantages as described above.

Additionally, the disclosed embodiments are adaped for cooperating with a pipe of circular cross-section as this is the most commonly used shape in jig apparatus of this type. However, many other types of elongate, rigid members may be used in lieu of a pipe, including hollow or solid rods and bars of circular, square, rectangular, or other suitable cross-section.

The embodiments of the invention in which an exclusive property or privilege is claimed as follows:

1. A manually operated jack lever for use with a jig apparatus of the type that includes a rigid, elongate section of pipe and at least first and second tail stops mounted on the pipe and each releasably gripping it in such a manner that a force applied to either of said tail stops in one lengthwise direction causes the tail stop to increase its grip on the pipe and thereby resist movement in such direction, while a force applied to either of said tail stops in the opposite lengthwise direction causes the tail stop to release its grip on the pipe and slide freely therealong, said jack lever comprising:

an elongate lever means having first and second ends and having a handle disposed adjacent said first end;

fulcrum support means, said lever means being pivotally mounted on said fulcrum support means at a location adjacent said second end of said lever means;

attachment means for attaching said fulcrum support means to a pipe so that the axis of the pivotal mounting of said lever means on said fulcrum support means extends transversely adjacent to said pipe;

camming means affixed to said lever means adjacent the second end thereof for movement generally lengthwise of the pipe in the reaction to manual reciprocation of said handle of said lever means when said fulcrum support means is attached to said pipe, by said attachment means, between the first and second tail stops, and said camming means being detachably engageable with the adjacent end of the second tail stop so that when said lever means is stroked one way said camming means thereon forcibly displaces the second tail stop in said opposite lengthwise direction along the pipe while the first tail stop reactively braces said fulcrum support means against displacement in said one lengthwise direction and so that once the second tail stop has been displaced to a desired position, said camming means is detachable from the second tail stop allowing removal of said jack lever from the pipe while leaving the second tail stop gripping the pipe at such desired position.

2. The jack lever of claim 1 wherein said attachment means comprises a C-shaped collar having a gap that is sized to fit over the outer diameter of the pipe from the side thereof and said fulcrum support means is affixed to said collar, such that when said collar is fitted on said pipe between the first and second tail stops said collar is shouldered against said first tail stop to brace said fulcrum support means against displacement along the pipe in said one lengthwise direction.

3. The jack lever of claim 1 wherein said attachment means comprises means affixing said fulcrum support to said first tail stop, and further comprising hook means affixed to said lever means adjacent the second end thereof, and means associated with the second tail stop for coacting with said hook means such that when the handle of said lever means is stroked oppositely from said one way, said fulcrum support means and the first tail stop are pulled toward the second tail stop in said opposite lengthwise direction in reaction to the second end of said lever being held against movement in said one lengthwise direction by said second tail stop and said means associated therewith that coact with said hook means.

4. The jack lever of claim 1 wherein said attachment means comprises means affixing said fulcrum support to said first tail stop, and wherein said first tail stop has a through bore fitted to the outer circumference of said pipe and has a split sleeve construction comprising first and second interlockable sleeve parts each defining a symmetrical half of said bore, said sleeve parts being individually positionable on the pipe from opposite sides thereof and thereafter interlockable to mount said first tail stop on the pipe, whereby the first tail stop and said fulcrum support means affixed thereto are removably mountable on the pipe, at any desired intermediate position therealong, without the need to slip the tail stop and associated fulcrum support means and lever means over an end of the pipe.

5. The jack lever of claim 1 wherein said elongate lever means is forked adjacent said second end and is pivotally mounted on said fulcrum support means at a location intermediate said first and second ends 50 that the forked portions of said lever means at said second end straddle the pipe, and wherein said camming means comprises cams mounted on said forked portions of said lever means on opposite sides of said pipe and at a location along said lever that is on the opposite side of said pivot axis from said handle.

6. A multipurpose jig apparatus for use with an elongate rigid pipe comprising:

first and second releasable tail stops which when mounted on a pipe, grip the pipe in such a manner that the tail stops are prevented from moving along the pipe in reaction to applied forces oriented in a first lengthwise direction and are permitted to move along the pipe in reaction to applied forces oriented in a second and opposite lengthwise direction;

an elongate jack lever, a fulcrum support for said lever, and means for attaching said fulcrum support to the pipe in a manner such that the first tail stop prevents lengthwise movement of said fulcrum support means in said first direction;

means for pivotally connecting said lever intermediate its ends to said fulcrum support means so that a first end of said lever projects outwardly and away from the pipe and the second end of said lever is positioned proximate to the pipe; and means carried by the second end of said lever for detachably coupling said second end of said lever to the second tail stop for applying a force between the first and second tail stops that displaces one of said tail stops along the pipe in said second direction in reaction to the other tail stop which resists the counteracting force which is oriented in the first direction.

7. In a multipurpose jig apparatus including an elongate rigid pipe, first and second tail stops mounted on and releasably gripping the pipe in a manner that permits the tail stops to be moved therealong in a first direction, but restrains such tail stops from being forced along the pipe in a second and opposite direction, the improvement in combination therewith of a mechanism for jacking the tail stops along the pipe, comprising:

an elongate lever having first and second ends and having a handle provided adjacent the first end;

fulcrum support means, said lever being pivotally connected to said fulcrum support means adjacent the second end of said lever;

attachment means for attaching said fulcrum support means to the pipe such that the axis of the pivotal connection that connects said lever and fulcrum support means extends transversely of and adjacent to the pipe such that when said fulcrum support means is positioned between the first and second tail stops it is braced by the first tail stop against movement along the pipe in said first direction; and camming means disposed on said lever adjacent its second end for detachably engaging the second tail stop such that when the lever is stroked one way the second tail stop is forcibly displaced by said camming means along the pipe in the second direction in reaction to the bracing of said fulcrum support means against movement along the pipe in the first direction by the first tail stop and such that once the second tail stop has been displaced to a desired position along the pipe said camming means is detachable from the second tail stop allowing removal of said mechanism from the pipe while leaving the second tail stop gripping the pipe at such desired position.

8. The improvement set forth in claim 7 wherein said attachment means comprises a C-shaped collar that has a gap in its C-shape sized to be fitted over the pipe from a side thereof such that said collar extends about a substantial circumferential segment of the pipe, and wherein said fulcrum support means is affixed to said C-shaped collar.

9. The improvement set forth in claim 7 wherein said first tail stop has a body formed with a bore therethrough that is sized to slidably fit on the outer circumference of said pipe, and has a releasable, spring-biased dog that normally grips the pipe and holds the tail stop against sliding movement along the pipe in reaction to a force oriented along the pipe in said first direction, and wherein said means for attaching said fulcrum support means to the pipe comprises affixing said fulcrum support means to the body of said first tail stop.

10. The improvement set forth in claim 7 wherein the first tail stop comprises a body having a bore therethrough which is sized to slidably fit on the outer circumference of the pipe, and has first and second interlockable split sleeve parts, each defining one symmetrical half of the bore and being separable and rejoinable to selectively remove and remount the first tail stop on the pipe at any selected location, intermediate the ends thereof, without requiring that the first tail stop be slid on and off over an end of the pipe, and wherein said means for attaching said fulcrum support means to the pipe comprises means affixing said fulcrum support to one of said sleeve parts of the first tail stop.

11. The improvement set forth in claim 9 further comprising hook means provided on said lever adjacent its second end, and hook receiving means provided on the second tail stop for coacting with said hook means to enable said fulcrum support means and thus the body of the first tail stop to which said fulcrum support means is affixed to be pulled toward the second tail stop when said lever is stroked the other way.

12. The improvement set forth in claim 11 wherein said camming means and said hook means and said hook receiving means comprise means associated therewith for accommodating a transversely oriented component of movement of said second end of said lever means as said second end of said lever means moves in an arcuate path when said lever is pivotally stroked.

13. The improvement set forth in claim 10 wherein said second tail stop comprises a body having a bore therethrough which is sized to slidably fit on the outer circumference of the pipe, and has first and second interlockable split sleeve parts, each defining one symmetrical half of the bore and being separable and rejoinable to selectively remove and remount the second tail stop on the pipe at any selected location, intermediate the pipe ends, whereby both the first and second tail stops and the associated mechanism for jacking such tail stops along the pipe can be removed and remounted on the pipe without requiring that they be slid on and off over a free end of the pipe.

* * * * *

UNITED STATES PATENT AND TRADEMARK OFFICE

CERTIFICATE OF CORRECTION

PATENT NO. : 4,160,539

DATED : July 10, 1979

INVENTOR(S) : Harold R. Johnson

It is certified that error appears in the above-identified patent and that said Letters Patent are hereby corrected as shown below:

Column 1, line 33, "dog thereby resisting increases resisting any" should be --dog also increases thereby resisting any--.
Column 11, line 4, "whle" should be --while--.
Column 13, line 5, "rotted" should be --rotated--.
Column 15, line 54, "thereof and" should be --thereof, and--.
Column 16, line 24, "50" should be --so--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*